US009750363B2

(12) United States Patent
Burton

(10) Patent No.: US 9,750,363 B2
(45) Date of Patent: Sep. 5, 2017

(54) ZIPPER PULLING DEVICE

(71) Applicant: Alberta Burton, Beach Island, SC (US)

(72) Inventor: Alberta Burton, Beach Island, SC (US)

( * ) Notice: Subject to any disclaimer, the term of this patent is extended or adjusted under 35 U.S.C. 154(b) by 0 days.

(21) Appl. No.: 15/192,101

(22) Filed: Jun. 24, 2016

(65) Prior Publication Data

US 2017/0099972 A1 Apr. 13, 2017

Related U.S. Application Data

(60) Provisional application No. 62/240,193, filed on Oct. 12, 2015.

(51) Int. Cl.
*A47G 25/90* (2006.01)

(52) U.S. Cl.
CPC ..... *A47G 25/902* (2013.01)

(58) Field of Classification Search
CPC ..... A47G 25/902; A44B 19/262; B25J 1/04
USPC ..... 294/3.6, 24, 175, 190, 210
See application file for complete search history.

(56) References Cited

U.S. PATENT DOCUMENTS 2,531,805 A 11/1950 Clark
2,845,297 A 7/1958 Doop
2,939,193 A 6/1960 Morgan
3,017,680 A 1/1962 Duncan
3,276,087 A * 10/1966 Hanson ..... A47G 25/902 294/104
4,015,296 A * 4/1977 Malick ..... A41B 11/00 2/239
5,100,191 A 3/1992 Detrick et al.
5,249,832 A 10/1993 Leonardz
5,558,377 A * 9/1996 Blum ..... B25J 1/00 294/210
5,647,623 A * 7/1997 Shiao ..... B25J 1/04 294/65.5
6,032,996 A * 3/2000 Kogen ..... A47G 25/901 24/40
6,065,787 A * 5/2000 Jarosch ..... B25B 9/00 294/210
6,588,065 B1 * 7/2003 Tucker, III ..... B25G 1/04 16/426
6,669,024 B2 * 12/2003 Ottens ..... B03C 1/30 209/215
8,167,310 B2 * 5/2012 Ruggiero ..... A63B 67/06 273/317
2012/0169076 A1 * 7/2012 Brake ..... A47G 25/902 294/3.6

* cited by examiner

*Primary Examiner* — Dean Kramer
(74) *Attorney, Agent, or Firm* — Global Intellectual Property Agency, LLC; Daniel Boudwin

(57) ABSTRACT

A zipper pulling device for allowing a user to more easily zip up a dress or other similar garment. The zipper pulling device includes a rod having a first end and a second end, wherein the rod is telescopic such that it can be extended or retracted to a desired length. The first end comprises a magnet thereon that can be used to engage a metal zipper. The second end of the rod includes a hook thereon, wherein the user can alternately use the hook to engage the zipper. In this way, the user can grasp an end of the rod and pull the rod upward so that the hook or magnet temporarily engaged with the zipper pulls along the teeth of the zipper, allowing a user to more easily zip up a dress.

2 Claims, 3 Drawing Sheets

ZIPPER PULLING DEVICE

CROSS REFERENCE TO RELATED APPLICATION

This application claims the benefit of U.S. Provisional Application No. 62/240,193 filed on Oct. 12, 2015. The above identified patent application is herein incorporated by reference in its entirety to provide continuity of disclosure.

BACKGROUND OF THE INVENTION

Field of the Invention

The present invention relates to zipper pulling devices. More specifically, the present invention provides a zipper pulling device comprising a rod having a first end with a magnet thereon and a second end having a hook that can be temporarily secured to a zipper such that the user can pull upward on the rod in order to zip-up a garment.

Dresses and other similar garments often have zippers on the sides or back thereof for securing the dress onto the wearer's body. However, zippers positioned on the back of a dress can be hard to access for the wearer. As a result, the wearer may have to twist or contort her arms in order to reach the zipper and then pull the zipper upward along the teeth of the zipper. Further, it is often necessary to hold the opposing sides of the zipper together so that the zipper will move easily along the teeth, otherwise, the zipper may become stuck as the wearer attempts to close the zipper. The wearer may have to ask another person to help zip up the dress which can be inconvenient or awkward. Further, having a person help to zip up the dress may not be an option if the wearer is alone while getting changed.

Devices have been disclosed in the prior art that relate to zipper pulling devices. These include devices that have been patented and published in patent application publications. These devices generally relate to zipper pulling devices for use in closing the zipper on a dress or other similar garment, such as U.S. Pat. No. 5,249,832, U.S. Pat. No. 2,845,297, U.S. Pat. No. 5,100,191, U.S. Pat. No. 2,939,193, U.S. Pat. No. 2,531,805, and U.S. Pat. No. 3,017,680.

These prior art devices have several known drawbacks. The devices in the prior art fail to provide a zipper pulling device having a telescopic rod that can be extended and retracted in length. Without the ability to adjust the length of the rod, the rod may not be long enough to allow the user to comfortably engage the zipper with the zipper pulling device. Further, such devices fail to provide a retraction mechanism adapted to cause the telescopic rod to automatically extend or retract.

In light of the devices disclosed in the prior art, it is submitted that the present invention substantially diverges in design elements from the prior art and consequently it is clear that there is a need in the art for an improvement to existing zipper pulling devices. In this regard the instant invention substantially fulfills these needs.

SUMMARY OF THE INVENTION

In view of the foregoing disadvantages inherent in the known types of zipper pulling devices now present in the prior art, the present invention provides a new zipper pulling device wherein the same can be utilized for providing convenience for the user when securing a zipper on a garment.

The present invention provides a zipper pulling device comprising an elongated, telescopic rod that can be adjusted in length. The first end of the rod comprises a magnet thereon that can be used to temporarily engage a zipper in order to pull the sliding member of the zipper along the teeth of the zipper. Alternatively, the second end of the zipper comprises a hook thereon that can also be used to engage a zipper if so desired. In some embodiments, the elongated rod further comprises a retraction mechanism adapted to cause the telescopic rod to automatically retract. In this way, the user can extend the telescopic rod, engage the hook or magnet with the zipper, and then automatically retract the elongated rod which draws the sliding member of the zipper along the teeth as the elongated rod retracts.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
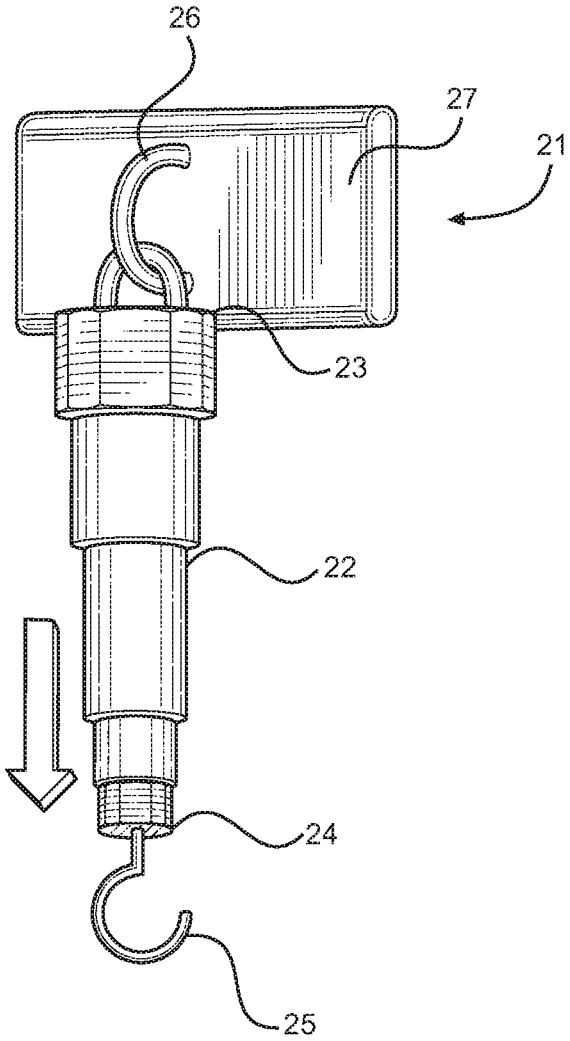
FIG. 1A shows a perspective view of the zipper pulling device in a retracted configuration.

Reference is made herein to the attached drawings. Like reference numerals are used throughout the drawings to depict like or similar elements of the zipper pulling device. For the purposes of presenting a brief and clear description of the present invention, the preferred embodiment will be discussed as used for closing the zipper of a garment, such as a dress. The figures are intended for representative purposes only and should not be considered to be limiting in any respect.

Figure 1B:
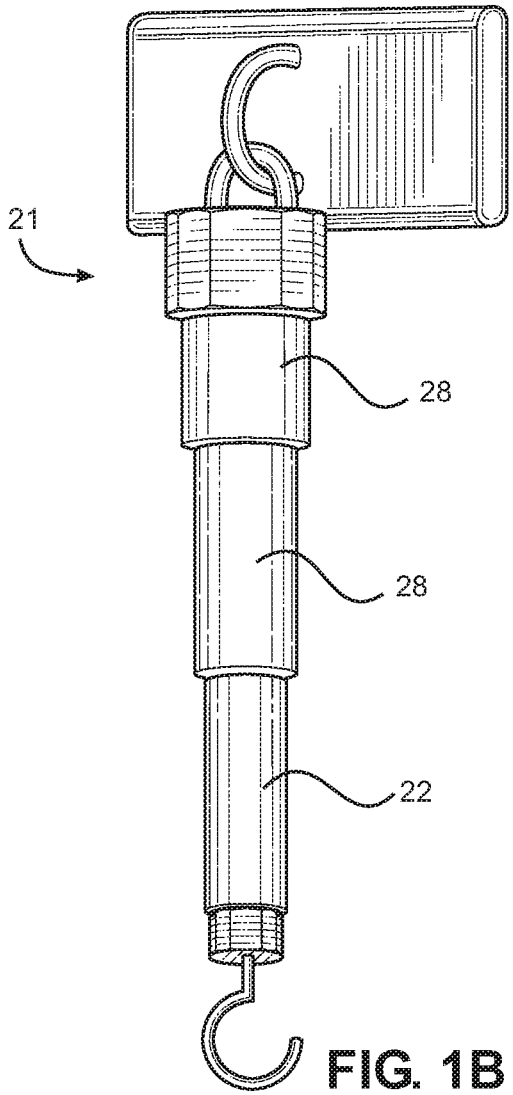
FIG. 1B shows a perspective view of the zipper pulling device in an extended configuration.

Referring now to FIGS. 1A and 1B, there are shown perspective views of the zipper pulling device in a retracted configuration and an extended configuration, respectively. The zipper pulling device 21 comprises an elongated rod 22 having a first end 23 and a second end 24. The elongated rod 22 comprises a telescopic configuration so that it can be extended or retracted in length as desired by the user. The elongated rod 22 preferably comprises a plurality of tubular sections 28 that are slidably inserted within one another so that the elongated rod 22 can be extended and retracted to a desired length.

The first end 23 of the elongated rod 22 comprises a magnet 27 thereon, wherein the magnet 27 is adapted to temporarily engage a metal zipper. The magnet 27 is shown as connected to the first end 23 via a linkage 26 so that the magnet 27 can be positioned at various angles or orientations relative to the elongated rod 22 as required to connect the magnet 27 to a zipper. In this way, the user can hold the second end 24 of the elongated rod 22 while the magnet 27 is engaged to a zipper in order to pull the zipper along the teeth such that the user does not have to grasp the zipper itself.

The second end 24 of the elongated rod 22 comprises a hook 25 thereon. The hook 25 is configured to be inserted into a portion of the sliding member of the zipper so as to be temporarily secured thereto. In this way, the user can hold the first end 23 of the elongated rod 22 and can pull the rod so that the zipper is drawn along the teeth of the zipper.

Figure 2:
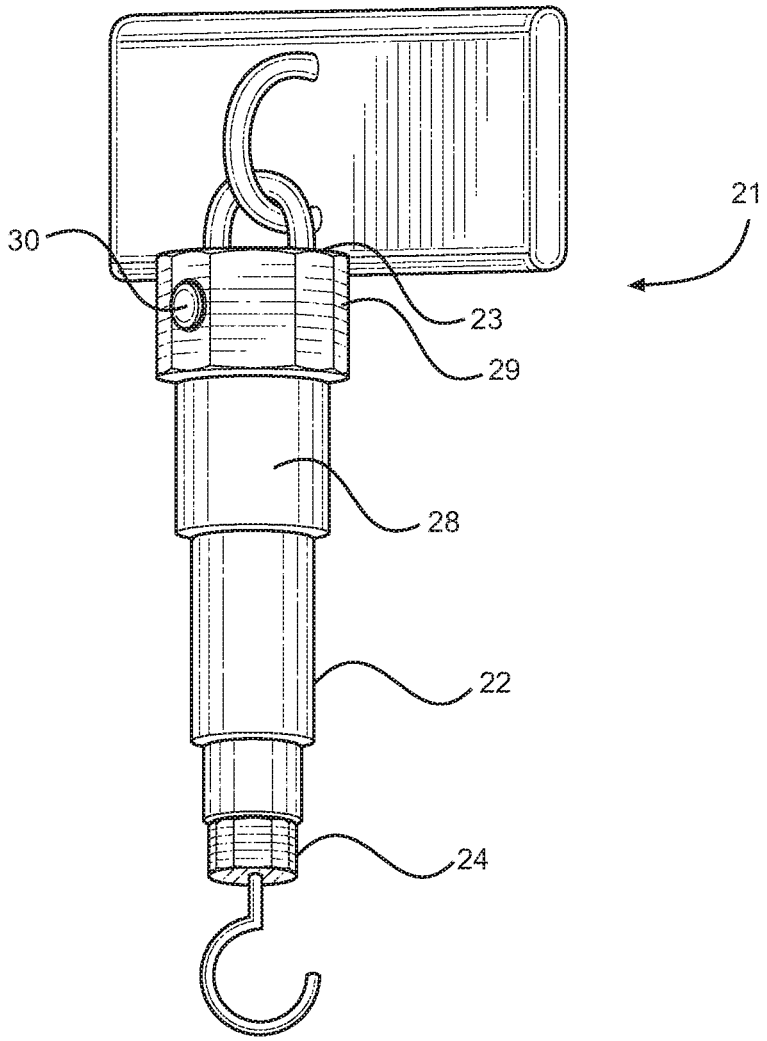
FIG. 2 shows a perspective view of an alternate embodiment of the zipper pulling device.

Referring now to FIG. 2, there is shown a perspective view of an embodiment of the zipper pulling device. In the illustrated embodiment, the zipper pulling device 21 further comprises an extension mechanism 29 disposed on the elongated rod 22. Preferably, the extension mechanism 29 is positioned on the first end 23 of the elongated rod 22, however, in alternate embodiments the extension mechanism 29 is positioned on the second end 24. The extension mechanism 29 is adapted to cause the elongated rod 22 to automatically extend and/or retract. A control 30 is disposed on the extension mechanism 29, wherein the user may actuate the control 30 in order to cause the tubular sections 28 of the elongated rod 22 to extend or retract. The extension mechanism 29 may comprise a motor, spring, or an actuator depending upon the embodiment.

Figure 3:
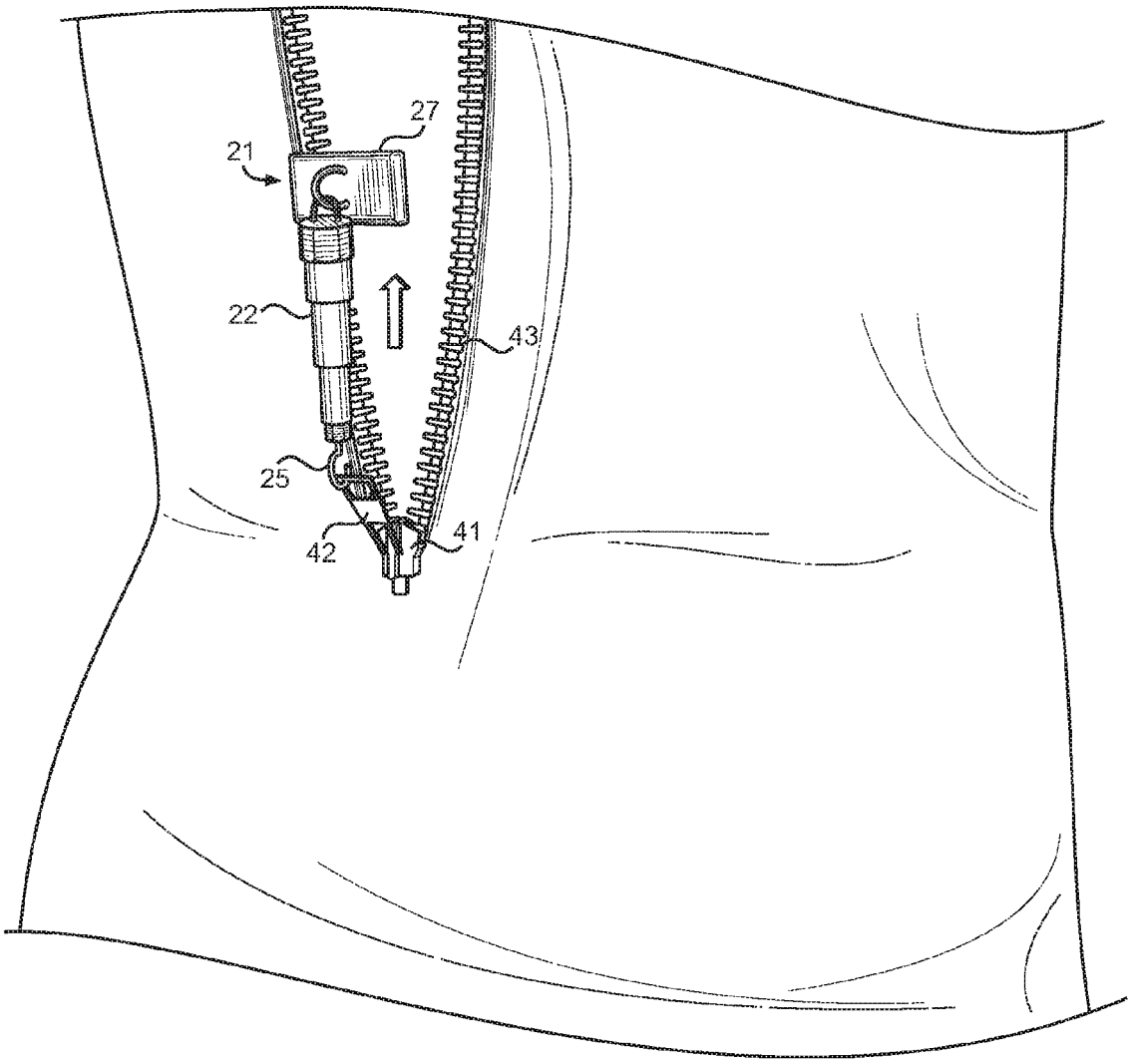
FIG. 3 shows a perspective view of the zipper pulling device in use.

Referring now to FIG. 3, there is shown a perspective view of the zipper pulling device in use. In operation, the user can extend the elongated rod 22 of the zipper pulling device 21. The user can temporarily secure the magnet 27 or the hook 25 of the zipper pulling device 21 to the slide fastener 42 of a zipper 41. The user can then hold a portion of the elongated rod 22 and move the rod 22 in an upward motion in order to draw the slide fastener 42 along the teeth 43 to close the zipper 41. This allows a user to more easily fasten the zipper 41 and eliminates the need for the user to have to hold the zipper 41 in his or her hand.

In embodiments having the extension mechanism, the user can secure the hook 25 to the slide fastener 42 of a zipper 41 and can hold the elongated rod 22 in an upright orientation. The user can then actuate the control on the first end of the elongated rod 22, such that the rod 22 retracts into a retracted configuration, drawing the zipper 41 along the teeth in the process. This eliminates the need for the user to pull the rod 22 or move his or her arm in order to close the zipper 41.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A zipper pulling device, comprising:

an elongated rod having a first end and a second end, wherein the elongated rod has a telescopic configuration;

the first end having a magnet disposed thereon, wherein the magnet is adapted to be temporarily affixed to a zipper;

the second end having a hook disposed thereon, wherein the hook is adapted to be temporarily affixed to a zipper;

the magnet connected to the elongated rod via a linkage;

the linkage comprises a first ring interconnected with a second ring, wherein the linkage provides free rotation of the magnet relative to the elongated rod.

2. The zipper pulling device of claim 1, wherein the elongated rod comprises a plurality of tubular sections slidably positioned within one another and adapted to extend and retract.

* * * * *